US005248471A

United States Patent [19]

Kavesh

[11] Patent Number: 5,248,471

[45] Date of Patent: Sep. 28, 1993

[54] PROCESS FOR FORMING FIBERS

[75] Inventor: Sheldon Kavesh, Whippany, N.J.

[73] Assignee: AlliedSignal Inc., Morristown, N.J.

[21] Appl. No.: 723,682

[22] Filed: Jun. 24, 1991

Related U.S. Application Data

[63] Continuation of Ser. No. 368,110, Jun. 20, 1989, abandoned, which is a continuation of Ser. No. 69,684, Jul. 6, 1987, abandoned.

[51] Int. Cl.[5] ..... D01F 6/04; D01F 6/14

[52] U.S. Cl. ..... 264/184; 264/185; 264/203; 264/205; 425/464

[58] Field of Search ..... 425/464; 264/203, 176.1, 264/210.8, 211.14, 211.16, 234, 182, 184, 185, 178 F, 205, 206

[56] References Cited

U.S. PATENT DOCUMENTS

| | | | |
|---|---|---|---|
| 3,049,753 | 8/1962 | Ogden | 425/464 |
| 3,174,183 | 3/1965 | Siegel | 425/461 |
| 3,303,531 | 2/1967 | Ogden | 425/464 |
| 4,137,032 | 1/1979 | Honnaker et al. | 425/464 |
| 4,413,110 | 11/1983 | Kavesh et al. | 264/205 |
| 4,440,711 | 4/1984 | Kwon | 264/185 |
| 4,551,296 | 11/1985 | Kavesh et al. | 264/203 |
| 4,551,299 | 11/1985 | Shields | 376/261 |
| 4,599,267 | 7/1986 | Kwon et al. | 428/364 |
| 4,883,628 | 11/1989 | Kwon et al. | 264/178 F |

FOREIGN PATENT DOCUMENTS

| | | |
|---|---|---|
| 139141 | 5/1985 | European Pat. Off. . |
| 3004699 | 5/1980 | Fed. Rep. of Germany . |
| 985729 | 3/1965 | United Kingdom . |
| 1100497 | 1/1968 | United Kingdom . |
| 2051667 | 1/1981 | United Kingdom . |

OTHER PUBLICATIONS

"Man-Made Fibers Manufacture", *Encyclopedia of Polymer Science and Technology*, vol. 8, pp. 374–404.

"Continuous Extrusion and Orientation of Transparent Polythylene Fiber", T-T Zill Tai/Degree Date 1975/UMI Dissertation.

R. Hill, "Fibers from Synthetic Polymers", pub. 1953, Elsevier Pub. Co. (Amsterdam), pp. 368–369, spec. p. 369, lines 2–3.

Billmeyer, "Textbook of Polymer Science", 2nd Ed., John Wiley & Sons, 1971, pp. 518–525.

*Primary Examiner*—Leo B. Tentoni

[57] ABSTRACT

This invention relates to a process in which a fiber is formed by spinning a melt or solution of a polymer through a capillary spinneret having a length/diameter (L/D) ratio equal to or greater than about 25:1, and fibers formed by such method

8 Claims, No Drawings

PROCESS FOR FORMING FIBERS

This application is a continuation of application Ser. No. 368,110 filed Jun. 20, 1989 now abandoned, which is a continuation of Ser. No. 069,684 filed on Jul. 6, 1987 (abandoned).

BACKGROUND OF THE INVENTION (1) Field of the Invention

This invention relates to a process for forming fibers, and fibers formed by the process. More particularly, this invention relates to such a process in which said fiber is formed by spinning a melt or solution of a polymer through a capillary spinneret having a length-/diameter (L/D) ratio equal to or greater than about 60:1, and fibers formed by such method (2) Prior Art Melt and solution methods of spinning fibers are known. For example, PAN has been spun conventionally using either wet spinning (e.g., 9.5% PAN in sodium thiocyanate-water (50:50) spun into 10% sodium thiocyanate in water at −2° C. for coagulation) or dry spinning (e.g., 30% PAN in diethylformamide spun at 103° C.) Typical properties of the resultant fibers are 2.4–3.7 g/denier tenacity and 42–53 g/denier tensile molecules. See Table 1 on page 155 of S.S. Chari et al., *Fibre Science and Technology,* Vol. 15, pp. 153–60 (1981). Mention is also made of PAN fibers in Smith et al. U.S. Pat. No. 4,344,908 (1982) concerned primarily with polyethylene fibers. Also concerned primarily with polyethylene fibers is U.S. Pat. No. 4,413,110 of Kavesh and Prevorsek (Nov. 1, 1983).

Zwick et al. in Soc. Chem. Ind., London. Monograph No. 30, pp. 188–207 (1968) describe the spinning of polyvinyl alcohol by a Phase Separation technique said to differ from earlier Wet Spinning, Dry Spinning and Gel Spinning techniques. The reference indicates that the earlier systems employ 10–20%, 25–40% and 45–55% polymer concentrations, respectively, and that they differ in the manner in which low molecular weight materials (solvents such as water) are removed. The reference also indicates some earlier systems to be restricted in spinneret hole size, attenuation permitted or required, maximum production speed and attainable fiber properties.

The Phase Separation process described in Zwick et al. (see also UK Patent Specification No. 1,100497) employs a polymer content of 10–25% (broadly 5–25% in the Patent which covers other polymers as well) dissolved at high temperatures in a one or two-component solvent (low molecular weight component) system that phase separates on cooling. This phase separation took the for of polymer gellation and solidification of the solvent (or one of its components), although the latter is indicated in the patent to be optional. The solution was extruded through apertures at the high temperature through unheated air and wound up at high speeds hundreds or thousands of times greater than the linear velocity of the polymer solution through the aperture. Thereafter the fibers were extracted to remove the occluded or exterior solvent phase, dried and stretched. An earlier, more general description of Phase Separation Spinning is contained in Zwick, Applied Polymer Symposia, no. 6, pp. 109–49 (1967).

Modifications in the spinning of hot solutions of ultrahigh molecular weight polyethylene (see Examples 21–23 of UK No. 1,100,497) have been reported by Smith and Lemstra and by Pennings and coworkers in various articles and patents including German Offen No. 3004699 (Aug. 21, 1980); UK Application 2,051,667 (Jan. 21, 1981); Polymer Bulletin, vol. 1, pp. 879–880 (1979) and vol. 2, pp. 775–83 (1980); and Polymer, Vol. 21, pp. 3–4 (1980). Copending commonly assigned applications of Kavesh et al., U.S. Pat. Nos. 4,413,110 and 4,551,296 describe processes including the extrusion of dilute, hot solutions of ultrahigh molecular weight polyethylene or polypropylene in a nonvolatile solvent followed by cooling, extraction, drying and stretching. While certain other polymers are indicated in U.S. Pat. No. 4,413,110 as being useful in addition to polyethylene or polypropylene, such polymers do not include polyvinyl alcohol or similar materials While U.K. Patent No. 1,100,497 indicates molecular weight to be a factor in selecting best polymer concentration (page 3, lines 16–26), no indication is given that higher molecular weights give improved fibers for polyvinyl alcohol. The Zwick article in Applied Polymer Symposia suggests 20–25% polymer concentration as optimum for fiber-grade polyvinyl alcohol, but 3% polymer concentration to be optional for polyethylene. The Zwick et al article states the polyvinyl alcohol content of 10–25% in the polymer solution to be optimal, at least in the system explored in most detail where the solvent or a component of the solvent solidified on cooling to concentrate the polyvinyl alcohol in the liquied phase on cooling before the polyvinyl alcohol gels.

Unlike the systems used in the Kavesh et al. applications and Smith and Lemstra patents, all three versions of Zwick's Phase Separation process take up the fiber directly from the air gap, without a quench bath, such that the draw-down occurred over a relatively large length of cooling fiber.

U.S. Pat. Nos. 4,599,267 and 4,440,711 describe a process for preparing fibers composed of a linear ultrahigh molecular weight polyvinyl alcohol.

Polyester and polyamide fibers and processes for forming such fibers are known. For example, the preparation and properties of nylon 6 and nylon 66 fibers are described in "Man Made Fibers, Science and Technology," Vol. 2. H. F. Mark et al., Eds., Interscience, N.Y., 1968. Polyester Fibers and Spinning Processes are described in Vol. 3 of the same work. In discussing spinneretes, it is said, "The capillary diameters usually range from 0.2 to 0.3 mm and their height ranges from 1 to 3 times the diameter." From a rheological point of view, the spinneretes must be properly considered as holes in a plate" p. 258, lines 1–4, "Man Made Fibers Science and Technology," Vol. 2, H. F. Mark et al., Eds , Interscience, N.Y., 1968.

Methods of preparing high tenacity, high modulus fibers have previously been described in U.S. Pat. Nos. 4,413,110, 4,440,711, 4,551,296 and 4,599,267. It was disclosed that, the length of the spinning aperature in the flow direction should normally be at least about 10 times the diameter of the aperature, or other similar major axis, preferably at least 15 times and more preferably at least 20 times the diameter, or other similar major axis. Such L/D (length/diameter) ratios of about 20/1 for the spinneret were within the bounds of prior art. See for example, "Man Made Fibers, *Science and Technology* Vol 1, p. 39, Interscience Publishers, N.Y., 1967.

Use of a die of 576:140 was investigated in connection with a process to produce a transparent polyethylene fiber. T.Y.T. Tam in a Ph.D. Thesis entitled "Continuous Extrusion and Orientation of Transparent Polyethylene Fiber", Ohio University, 1975 found that continuous extrusion was not possible with the high L/D die under the conditions of the investigation.

SUMMARY OF THE INVENTION

This invention relates to an improved process for forming fibers of the type in which a melt or solution of a polymeric material is spun through a spinneret, the improvement comprising a capillary spinneret having an L/D ratio greater than about 25:1. As used herein, "L/D ratio" is the ratio of the length of the spinneret to the diameter of the orifice of the spinneret. It will be understood that the constant or substantially constant diameter section of the orifice may be preceded by a tapered inlet or included angle between about 3° and 150°. The L/D ratio applies to that section of the spinneret having a substantially constant diameter. Surprisingly, it has now been found that when L/D ratios greater than about 25:1 are employed, high tenacity, high modulus fibers of improved uniformity and cylindricity may be prepared. Furthermore, the tenacity and modulus of such yarns are improved and are less sensitive to spinning throughout than if the yarns are prepared with dies of lesser L/D.

DESCRIPTION OF THE PREFERRED EMBODIMENTS

The present invention includes one essential step of spinning a "fiber spinning composition" through at least one capillary spinneret having a position extending from the orifice of substantially constant cross-section and which has an L/D ratio greater than about 25:1. Surprisingly, it has been discovered that a relationship between L/D ratio of the spinneret and the properties of the fibers exists. More particularly, it has been discovered that when capillary spinnerets with L/D ratios greater than about 25:1 are employed, the uniformity of the physical parameters, such as modulus, tenacity, of the fiber are improved. In general, the L/D ratio of the spinnerets used in the practice of this invention is greater than about 25:1. The upper limit of the L/D ratio is not critical and can vary widely depending only on such factors as the desired denier of the fiber and the practical limitation, space, and the like on the length of the fiber. In the preferred embodiments of the invention the L/D ratio of the spinneret is equal to or greater than about 60:1, and in the particularly preferred embodiments of the invention the L/D ratio of the capillary spinneret is equal to or greater than about 70:1. Amongst these particularly preferred embodiments, most preferred are those in which the L/D ratio of the spinneret is equal to or greater than about 80:1, with a ratio equal to or greater than about 100:1 being the ratio of choice.

In the preferred embodiments of the invention, the spinneret is of "substantially constant cross-section". As used herein, "substantially constant means over the length of the spinneret. In the particularly preferred embodiments of the invention, the cross-section of the spinneret along its entire length does not vary more than about 10%, and in the most preferred embodiments of the invention, the cross-section does not vary more than about 5%.

Preferred spinnerets for use in the practice of this invention are "capillary spinnerets". As used herein, "capillary spinnerets" are spinnerets in which the geometric shape of the spinneret is substantially constant along the length of the spinneret. Thus, if the cross-section of the spinneret is circular at its entry end, it is circular at its exit end. Similarly, if the cross-section is rectangular or other-shape at the entry end, the exit cross-section is a rectangle or other shape of the same relative proportion.

In the practice of this invention, a "fiber spinning composition" is used. As used herein, a "fiber spinning composition" is a melt or solution of a polymer of fiber forming molecular weight. The nature of the spinning composition may vary widely. For example, the spinning composition may be a melt, of a polymer or other material used in the formation of the fiber, and may be spun using conventional techniques, as for example those melt spinning techniques described in "Man Made Fibers Science and Technology" Vol. 1-3, H. F. Mark et al., Interscience N.Y., 1968 and "Encyclopedia of Polymer Science and Technology," Vol. 8.

Similarly, the fiber spinning composition may be a solution of the polymer and other material used in the formation of the fiber, which may be spun by using conventional solution spinning techniques, as for example those described in U.S. Pat. Nos. 2,967,085; 2,716,586; 2,558,730; 3,147,322; 3,047,356; 3,536,219; 3,048,465; British Patent Nos. 985,729 and 1,100,497; and in the article by M. E. Epstein and A.J. Rosenthal, Textile res. J. 36,813 (1966).

In the preferred embodiment of the invention, fiber spinning compositions are solutions of natural or synthetic polymers, and solution spinning techniques are employed, especially those described in U.S. Pat. Nos. 4,413,110; 4,440,711, 4,551,296 and 4,599,267.

In these preferred embodiments of the invention, the fibers are spun from melts or solutions of polymers of fiber forming molecular weight. The nature of the polymer can vary widely, and any polymer known for use in forming fibers may be used. The polymer may be any of a variety of conventional thermoplastics used in fiber production which are of fiber forming molecular weight. The meaning of this term is well known in the art. For example, in the case of polyamides and polyaramides for example KEVLAR, an aramed fiber available from DuPont Corp., nylon 6 and nylon 66, a fiber forming molecular weight generally means a number average molecular weight of at least about 10,000. In the case of polymers of $\alpha$, $\beta$- unsaturated monomers such as polyethylene, polyacrylonitrile and polyvinyl alcohol as fiber forming molecular weight is usually a number average molecular weight of at least about 2,000, and in the case of polyesters such as polyethylene terephthalate a fiber forming molecular weight is usually a number of at least about 10,000.

Any polymer that can be spun into a fiber can be used in the process of this invention. Illustrative of polymers which may be utilized in the process of this invention are synthetic linear polycarbonamides characterized by the presence of recurring carbonamide groups as an integral part of the polymer chain which are separated from one another by at least two carbon atoms. Polyamides of this type include polymers, generally known in the art as nylons, obtained from diamines and dibasic acids having the recurring unit represented by the general formula:

$$-NHCORCONHR^1-$$

in which R is an alkylene group of at least two carbon atoms, preferably from about 2 to about 10; and $R^1$ is selected from R and phenyl groups. Also included are copolyamides and terpolyamides obtained by known methods, as for example, by condensation of hexamethylene diamine and a mixture of dibasic acids consisting of terephthalic acids and derivatives thereof, as for example, lactams.

Polyamides of the above description are well known in the art and include, for example, the copolyamide of 30% hexamethylene diammonium isophthalate and 70% hexamethylene diammonium adipate, the copolyamide of up to 30% bis-(p-amidocyclohexyl)methylene, and terephthalic acid and caprolactam, poly(hexamethyleneadipamide) (nylon 66), poly(4-aminobutyric acid) (nylon 4), poly(7-aminoheptanoic acid) (nylon 7), poly(8-aminooctanoic acid) (nylon 8), poly(6-aminohexanoic acid) (nylon 6), poly(hexamethylene sebacamide) (nylon 6,10), poly(heptamethylene pimelamide) (nylon 7,7), poly(octamethylene suberamide) (nylon 8,8), poly(hexamethylene sebacamide) (nylon 6,10), poly(nonamethylene azelamide) (nylon 9,9), poly(decamethylene azelamide) (nylon 10,9), poly(-decamethylene sebacamide (nylon 10,10), poly[bis(4-amino-cyclohexyl)methane-1,10-decanedicarboxamide] ((Oiana) (trans)), poly(m-xylene adipamide), poly(p-xylene sebacamide), poly(2,2,2-trimethylhexamethylene terejtja;a,ode), poly(piperazine sebacamide), poly(-metaphenylene isophthalamide) Available from Du-Pont Corp. under the trademark NOME, poly(p-phenylene terephthalamide) (Kevlar), poly(11-amino-undecanoic acid) (nylon 11) poly(12-aminododecanoic acid) (nylon 12), polyhexamethylene isophthalamide, polyhexamethylene terephthalamide, poly(9-aminononanoic acid) (nylon 9) polycaproamide, or combinations thereof. The polyamide for use in the most preferred embodiments of this invention is polycapralactam which is commercially available from Allied Signal Inc. under the trademark Capron.

Other polymers which may be employed in the process of this invention are linear polyesters. The type of polyester is not critical and the particular polyester chosen for use in any particular situation will depend essentially on the physical properties and features, i.e., tensile strength, modulus and the like, desired in the final fiber. Thus, a multiplicity of linear thermoplastic polyesters having wide variations in physical properties are suitable for use in the process of this invention.

The particular polyester chosen for use can be a homo-polyester or a co-polyester, or mixtures thereof as desired. Polyesters are normally prepared by the condensation of an organic dicarboxylic acid and an organic diol, and, therefore, illustrative examples of useful polyesters will be described hereinbelow in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids and may be cycloaliphatic, aliphatic or aromatic polyesters.

Exemplary of useful cycloaliphatic, aliphatic and aromatic polyesters which can be utilized in the practice of their invention are poly(ethylene terephthalate), poly(cyclohexylenedimethylene, terephthalate, poly-(ethylene dodecate), poly(butylene terephthalate, poly[ethylene(2,7-naphthalate)], poly(metaphenylene isophthalate), poly(glycolic acid), poly(ethylene succinate), poly(ethylene adipate), poly(ethylene sebacate), poly(decamethylene azelate), poly(ethylene sebacate), poly(decamethylene adipate), poly(decamethylene sebacate), poly ($\alpha$, $\alpha$-dimethylpropiolactone), poly(para-hydroxybenzoate) (Ekonol), poly(ethylene oxybenzoate) (A-tell), poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylidene dimethylene terephthalate) (Kodel) (cis), and poly(1,4 cyclohexylidene dimethylene terephthalate (Kodel) (trans).

Polyester compounds prepared from the condensation of a diol and an aromatic dicarboxylic acid are preferred for use in this invention. Illustrative of such useful aromatic carboxylic acids are terephthalic acid, isophthalic acid and an o-phthalic acid, 1,3-, 1,4-, 2,6- or 2,7-napthalenedicarboxylic acid, 4,4'-diphenyl-dicarboxylic acid, 4,4'-diphenysulphone-dicarboxylic acid, 1,1,3-trimethyl-5-carboxy-3-(p-carboxyphenyl)-indane, diphenyl ether 4,4'-dicarboxylic acid, bis-p(carboxyphenyl)methane and the like. Of the aforementioned aromatic dicarboxylic acids based on a benzene ring such as terephthalic acid, isophthalic acid, orthophthalic acid are preferred for use and amongst these preferred acid precursors, terephthalic acid is particularly preferred.

In the most preferred embodiments of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

Still other polymers which may be used in the practice of this invention are polymers derived from unsaturated monomers of the formula:

$$R_1R_2C{=}CH_2$$

wherein $R_1$ and $R_2$ are the same or different and are hydrogen, alkyl, phenyl, alkaxyphenyl, alkylphenyl, halophenyl, alkylphenyl, perhalophenyl, haloalkyl, perhaloalkyl, nephthyl, cyano, phenoxy, hydroxy, carboxy, alkanoyl, amino, halogen, amide, alkoxycarbonyl, phenol, alkylamino, alkoxy, alkoxyalkyl, dialkylamino, pyridimo, carbazole, haloalkanoyl, perhaloalkanoyl, phenylcarbonyl, phenoxy carbonyl and pyrrolidino.

Illustrative of such polymers are polyethylene, polyvinyl alcohol, polypropylene, polystyrene, polyvinyl chloride, polyvinylene fluoride, polyacrylamide, polyacrylonitrile, polyvinyl pyridine, polyvinyl acetate, polyacrylic acid, polyvinyl pyrrolidine, polyvinyl methyl ether, polyvinyl formal, poly (P-vinyl phenol) and the like.

In the preferred embodiments of this invention, the polymer is a polymer formed from an $\alpha$, $\beta$-unsaturated olefins, especially those of the above formula in which $R_1$ is hydrogen and $R_2$ is hydrogen, alkyl, phenyl, cyano, and amide; polyesters and aromatic or aliphatic polyamides. In the particularly preferred embodiments of the invention, the polymer is polyethylene terephthalate nylon 6, nylon 66, aramid, polyacrylonitrile, polyvinyl alcohol and polyethylene. Amongst these particularly preferred embodiments, most preferred are those embodiments in which the polymer is polyethylene, polyacrylonitrile, and polyvinyl alcohol.

Preferred polyvinyl alcohol for use in this invention is linear and of weight average molecular weight of at least about 100,000. In the preferred embodiments of the invention, the weight average molecular weight is from about 200,000 to about 2,000,000, and in the particularly preferred embodiments is from about 250,000 to about 1,000,000. Amongst these particularly preferred embodiments most preferred are those embodiments of the invention in which the molecular weight of the polyvinyl alcohol is from about 300,000 to about 750,000. The term linear is intended to mean no more than minimal branches of either the alpha or beta type. Since the most common branching in polyvinyl acetate (PV-Ac) manufacture is on the acetate side-groups, such branching will result in side-groups being split off during hydrolysis or methanolysis to PV-OH and will result in the PV-OH size being lowered rather than its branching increased. The amount of total branching can be determined most rigorously by nuclear magnetic resonance. While totally hydrolyzed material (pure PV-OH) is preferred, copolymers with some vinyl acetate remaining may be used. Such linear ultrahigh molecular weight PV-OH can be prepared by low temperature photo-initiated vinyl acetate polymerization, followed by methanolysis, using process details described in the U.S. Pat. No. 4,463,138.

Preferred polyacrylonitrile for use in this invention is linear and of weight average molecular weight of at least about 200,000. Preferred polyacrylonitrile has a weight average molecular weight of from about 300,000 to about 4,000,000, and in the particularly preferred embodiments of the invention the polyacrylonitrile has a weight average molecular weight of from about 400,000 to about 2,500,000. Amongst these particularly preferred embodiments, most preferred are those embodiments of the invention in which the weight average molecular weight of the polyacrylonitrile is from about 1,000,000 to about 2,500,000.

Preferred polyethylene for use in this invention is linear and has a weight average molecular weight of at least about 200,000. Preferred polyethylene has a weight average molecular weight of from about 500,000 to about 4,000,000, and in the particularly preferred embodiments of the invention the polyethylene has a weight average molecular weight of from about 600,000 to about 3,000,000. Amongst these particularly preferred embodiments most preferred are those embodiments, the polyethylene has a weight average molecular weight of from about 700,000 to about 2,000,000.

Spinning apparatus used in the practice of this invention may vary widely and the extrusion step of our process may be conventional extrusion apparatus for spinning ordinary fibers of the same polymer. Thus, for example, in the melt spinning of nylon 6 and polyethylene terephthalate fibers, ordinary powder or pellet feed systems, extruders and spinnerets may be used as described in "Encyclopedia of Polymer Science and Technology", Vol. 8, pps. 326–381. Similarly, in the solution spinning of polyethylene, polyacrylonitrile and polyvinyl alcohol conventional solution spinning systems as described in British Patent 1,100,497; and U.S. Pat. Nos. 3,536,219; 3,048,465; and 4,421,708. The spinneret may have any number of apertures preferably of substantially constant cross-section. Each aperature will have the required L/D (length to diameter) ratios of equal to or greater than about 60:1 and may have various cross-sectional shapes, e.g., circular, rectangular Y-shaped, dog-boned, hexalobal, trilobal and the like. Regardless of the shape used, the effective diameter (in the case of a circle, an equivalent dimension giving the same cross-sectional area for the other shapes) is not critical and may vary widely as for example from about 0.1 mm to about 2.0 mm. An effective diameter from about 0.1 mm to about 1.5 mm is preferred, and an effective diameter between about 0.1 mm and about 1.0 mm is more preferred.

A preferred embodiment of the process of this invention comprises the steps:

(a) forming a solution of a polymer of an unsaturated monomer having a weight average molecular weight of at least about 100,000 in a first solvent at a first concentration of about 2 to about 30 weight percent of said polymer;

(b) extruding said solvent through an aperture of a spinneret, said spinneret having a substantially constant cross-section and an L/D ratio equal to or greater than about 60:1, said solvent being at a temperature no less than a first temperature upstream of the aperture and being substantially at the first concentration both upstream and downstream of said aperture;

(c) cooling the solvent adjacent to and downstream of the aperture to a second temperature below the temperature at which a rubbery gel is formed, forming a gel containing first solvent of substantially indefinite length;

(d) extracting the gel containing first solvent with a second, volatile solvent for a sufficient contact time to form a fibrous structure containing second solvent, which gel is substantially free of first solvent and is of substantially indefinite length;

(e) drying the fibrous structure containing second solvent to form a xerogel of substantially indefinite length free of first and second solvent; and (f) stretching at least one of:

(i) the gel containing the first solvent, (ii) the fibrous structure containing the second solvent and, (iii) the xerogel, at a total stretch ratio sufficient to achieve a tenacity of at least about 5 g/denier and a secant modulus of at least about 100 g/denier.

The first solvent should be substantially nonvolatile under the processing conditions. This is necessary in order to maintain essentially constant the concentration of solvent upstream and through the aperture (die) and to prevent non-uniformity in liquid content of the gel fiber or film containing first solvent. Preferably, the vapor pressure of the first solvent should be no more than 80 kPa (four-fifths of an atmosphere) at 130° C., or at the first temperature.

The polymer may be present in the first solvent at a first concentration which is selected from a relatively narrow range, e.g., about 2 to about 30 weight percent, preferably about 5 to about 20 weight percent more preferably about 6 to about 15 weight percent; however, once chosen, the concentration should not vary significantly adjacent the die or otherwise prior to cooling to the second temperature. The concentration at any one point should not vary adjacent the die or otherwise prior to cooling to the second temperature. The concentration should also remain reasonably constant over time (i.e., length of the fiber or film).

The first temperature is chosen to achieve complete dissolution of the polymer in the first solvent. The first temperature is the minimum temperature at any point between where the solution is formed and the die face, and must be greater than the gelation temperature for the polymer in the solvent at the first concentration. While temperatures may vary above the first temperature at various points upstream of the die face, excessive temperatures causative of polymer degradation should be avoided. To assure complete solubility, a first temperature is chosen whereat the solubility of the polymer exceeds the first concentration and is typically at least 20% greater. The second temperature is chosen whereat the first solvent-polymer system behaves as a gel, i.e., has a yield point and reasonable dimensional stability for subsequent handling. Cooling of the extruded polymer solution from the first temperature to the second temperature should be accomplished at a rate sufficiently rapid to form a gel fiber which is of substantially the same polymer concentration as existed in the polymer solution. Preferably the rate at which the extruded polymer solution is cooled from the first temperature to the second temperature should be at least 50° C. per minute.

A preferred means of cooling to the second temperature involves the use of a quench bath. The quench bath will preferably comprise a liquid which is relatively immiscible with the first solvent. The particularly preferred quench bath for use in the practice of this invention will comprise water or a mixture of the first solvent with water. Quenching temperatures that may be employed range from about 0° C. to about 50° C. with a temperature near room temperature being preferred.

As a result of those factors the gel fiber formed upon cooling to the second temperature consists of a continuous polymeric network highly swollen with solvent.

If an aperture of circular cross-section (or other cross-section without a major axis in the plane perpendicular to the flow direction more than 8 times the smallest axis in the same plane, such a oval, Y- or X-shaped aperture) is used, then both gels will be gel fibers, the xerogel will be a xerogel fiber and the thermoplastic article will be a fiber. The diameter of the aperture is not critical, with representative apertures being between 0.25 mm and 5 mm in diameter (or other major axis). The length of the aperture in the flow direction should normally be at least 60 times the diameter of the aperture (or other similar major axis), preferably at least 70 times and more preferably at least 80 times the diameter (or other similar major axis).

If an aperture of rectangular cross-section is used, then both gels will be gel films, the xerogel will be a xerogel film and the thermoplastic article will be a film. The width and height of the aperture are not critical, with representative apertures being between 2.5 mm and 2 mm in width (corresponding to film width), between 0.25 mm and 5 mm in height (corresponding to film thickness). The depth of the aperture (in the flow direction) should normally be at least 60 times the height and more preferably at least 80 times the height.

The extraction with second solvent is conducted in a manner that replaces the first solvent in the gel with a second more volatile solvent. When the first solvent is DMSO or DMF, a suitable second solvent is water. Preferred second solvents are the volatile solvents having an atmospheric boiling point of 100° C. or lower. Conditions of extraction should remove the first solvent to less than 1% solvent by weight of polymer in the gel after extraction.

With some first solvents such as DMSO or DMF, it is contemplated (but not preferred) to evaporate the solvent from the gel fiber near the boiling point of the first solvent and/or at subatmospheric pressure instead of or prior to extraction.

A preferred combination of conditions is a first temperature between 130° C. and 250° C., a second temperature between 0° C. and 50° C. and a cooling rate of at least 50° C./minute. The first solvent should be substantially non-volatile, one measure of which is that its vapor pressure at the first temperature should be less than four-fifths atmosphere (80 kPa). In choosing the first and second solvents, the primary desired difference relates to volatility as discussed above.

Once the fibrous structure containing second solvent is formed, it is then dried under conditions where the second solvent is removed leaving the solid network of polymer substantially intact. By analogy to silica gels, the resultant material is called herein a "xerogel" meaning a solid matrix corresponding to the solid matrix of a wet gel, with the liquid replaced by gas (e.g., by an inert gas such as nitrogen or by air). The term "xerogel" is not intended to delineate any particular type of surface area, porosity or pore size.

Stretching may be performed upon the gel fiber after cooling to the second temperature or during or after extraction. Alternatively, stretching of the xerogel fiber may be conducted, or a combination of gel stretch and xerogel stretch may be performed. The first stage stretching may be conducted in a single stage or it may be conducted in two or more steps. The first stage stretching may be conducted at room temperature or at an elevated temperature. Preferably the stretching is conducted in two or more stages with the last of the stages performed at a temperature between 100° C. and 260° C. Most preferably the stretching is conducted in more than two stages with the last of the stages performed at a temperature between 130° C. and 250° C.

Such temperatures may be achieved with heated tubes as in the Figures, or with other conventional heating means such as heated pins, heating blocks, steam or gas jets, pressurized steam, heated liquids or heated rolls. The stretching temperatures may also be obtained by use of laser or dielectric (microwave) heating.

The fiber product may be circular, polygonal, polylobal, or irregular in cross-sectional shape, and ordinarily has an "effective diameter" of between about 0.01 mm and about 1.0 mm, preferably between about 0.01 mm and about 0.1 mm. As used herein "the effective diameter" of the fiber is the diameter of a circle whose diameter corresponds to the cross sectional area of the fiber. Effective diameter corresponds generally to a denier which can range from about 0.8 to about 8000, and which preferably ranges between about 0.8 and about 80.

The fibers of this invention have unique properties. For example, the fibers have improved uniformity and cylindricity, and exhibit high tenacity and high modulus. For example, the product polyacrylonitrile fibers produced by the present process represent novel articles in that they include fibers with a unique combination of properties: a molecular weight of at least about 200,000, a (secant) modulus at least about 100 g/denier and a tenacity at least about 7 g/denier. For this polyacrylonitrile fiber, the molecular weight is preferably at least about 2,000,000, more preferably between about 300,000 and about 4,000,000 and most preferably between about 400,000 and about 2,500,000. In the preferred embodiments of the invention, the tenacity of the polyacrylonitrile fibers is at least about 11 g/denier, and in the particularly preferred embodiments is from about 11 to about 19 g/denier. Amongst these particularly preferred embodiments, most preferred are those polyacrylonitrile fibers in which the tenacity is greater than about 20 g/denier. The secant modulus is preferably at least about 100 g/denier, more preferably at least about 125 g/denier. Preferably the fiber has an elongation to break at most 7%.

Polyvinylalcohol fibers produced by the present process represent novel articles in that they include fibers with a unique combination of properties: a molecular weight of at least about 100,000, a modulus at least about 200 g/denier, a tenacity at least about 10 g/denier, melting temperature of at least about 238° C. For this fiber, the molecular weight is preferably at least about 200,000, more preferably between about 200,000 and about 2,000,000 and most preferably between about 250,000 and about 1,000,000. The tenacity is preferably at least about 14 g/denier and more preferably at least about 17 g/denier. The tensile modulus is preferably at least about 300 g/denier, more preferably 400 g/denier and most preferably at least about 550 g/denier. The melting point is preferably at least about 238° C.

It is also contemplated that the preferred other physical properties can be achieved without the 238° C. melting point, especially if polyvinyl alcohol fibers contains comonomers such as unhydrolyzed vinyl acetate. Therefore, the invention includes polyvinyl alcohol fibers with molecular weight at least about 200,000, tenacity of at least about 14 g/denier and tensile modulus at least about 300 g/denier, regardless of melting point. Again, the more preferred values are molecular weight between about 200,000 and about 2,000,000 (especially about 250,000–1,000,000), tenacity at least about 17 g/denier and modulus at least about 400 g/denier (especially at least about 550 g/denier). The product polyvinyl alcohol fibers also exhibit shrinkage at 160° C. less than 2% in most cases. Preferably the fiber has an elongation to break at most 7%.

The following examples are presented to more particularly illustrate the invention and are not to be construed as limitations thereon.

EXAMPLES 1 TO 4

A 6 wt % slurry of 22.4 IV polyethylene in mineral oil containing 0.25% antioxidant (Irganox 1010) was fed by means of a piston pump to a preheater and then under pressure to a single screw extruder of 3 inch (7.62 cm) ID barrel diameter and 3700 cu. cm. net internal volume. The temperature of the screw extruder was maintained at 290° C. along its length. The polyethylene was dissolved by passage through the preheater and the screw extruder. The discharge of the screw extruder was fitted with a Zenith gear pump which conveyed the 6 wt % polyethylene solution in mineral oil through a screen pack and into a spinneret consisting of 118 holes each of 0.040" (0.102 cm) diameter, and having varying length/diameter (L/D) ratios. The length/diameter ratio of the spinneret was 25:1 in examples 1 and 2, and 100:1 in examples 3 and 4. The spinning throughput rate was 236 cc/mn. in examples 1 and 3 and 472 cc/min. in examples 2 and 4.

The polymer solution was extruded through the spinneret to form solution filaments, which were quenched in water without change in composition to form gel filaments. The gel filaments were stretched at room temperature, extracted with trichlorotrifluoroethane, then dried and stretched again at 60° C., 130° C. and 150° C. The properties of the resulting yarns and of the individual filaments in these yarns were measured The filament aspect ratio is the ratio of the largest cross-sectional dimension to the smallest cross-sectional dimension averaged for about fifty filaments in each case.

The results are set forth in the following Tables I and II.

TABLE I

AVERAGE OF INDIVIDUAL FILAMENTS

| Example | Die L/D | Spinning Throughput, cc/min | Aspect Ratio | Denier Fil | Tenacity g/d | Modulus g/d |
|---|---|---|---|---|---|---|
| 1 | 25:1 | 236 | 3.01 | 9.5 ± 7.4% | 36.2 | 1236 |
| 2 | 25:1 | 472 | 2.97 | 9.3 ± 14% | 35.6 | 1452 |
| 3 | 100:1 | 236 | 2.73 | 6.9 ± 4.3% | 38.1 | 1607 |
| 4 | 100:1 | 472 | 2.80 | 7.7 ± 5.3% | 38.0 | 1652 |

TABLE II

YARN PROPERTIES

| Example | Die L/D | Spinning Throughput, cc/min | Denier | Tenacity g/d | Modulus g/d |
|---|---|---|---|---|---|
| 1 | 25:1 | 236 | 1050 | 31.5 | 1392 |
| 3 | 100:1 | 236 | 817 | 33.2 | 1555 |
| 2 | 25:1 | 472 | 1119 | 30.6 | 1358 |
| 4 | 100:1 | 472 | 908 | 33.2 | 1530 |

Comparing the results of example 1 with those of example 3, and the results of examples 2 with those of example 4, it will be seen that use of ultrahigh L/D die (100:1 vs. 25:1) produced the following results:

a) Filament aspect ratio was improved (more cylindrical) at each throughput.
b) The variation of filament denier was reduced at each throughput.
c) The average tenacity and modulus of individual filaments were higher at each throughput.
d) Yarn tenacity and modulus were higher at each throughput.
e) Yarn tenacity and modulus decreased less with increasing throughput.

EXAMPLE 5

A 6 wt % solution of 22.4 IV polyethylene was prepared as in examples 1 to 4 and extruded at the rate of 177 cc/mn. through a 121 hole spinneret of 0.015" (0.0381 cm) diameter and an L/D ratio of 15:1 L/D. The solution filaments were quenched in water to form gel filaments.

It was found that the gel filaments were of highly variable diameter along their lengths showing thick and thin sections. Further processing of this yarn was not attempted. The concentration of the polymer slurry feeding the extruder was reduced from 6 wt % to 4 wt %. The spinning throughput was maintained at 177 cc/mn. using the same spinneret as above. The quenched gel filaments were now of reasonably uniform diameter along their lengths. The gel yarn was stretched, extracted dried and stretched again. The properties of the resulting yarn were as follows:

173 Denier (1.43 denier/fil), 27.0 g/d tenacity, and 1179 g/d modulus. Individual filaments had a highly irregular crenulated cross-section of 3.2:1 aspect ratio averaged over about 50 filaments.

EXAMPLE 6

A 6 wt % solution of 22.4 IV polyethylene was prepared as in Example 5 and extruded through a 118 hole spinneret of 0.015" (0.0381 cm) diameter and 200:1 L/D. The solution filaments were quenched in water to form gel filaments. The gel filaments showed no apparent diameter variation along their lengths. The gel yarn was stretched, extracted, dried and stretched again. The properties of the resulting yarn were:

169 denier (1.43 denier/fil), 35.6 g/d tenacity and 1481 g/d/ modulus. The individual filaments showed a polygonal cross-section of 1.85:1 aspect ratio averaged over about 50 filaments.

EXAMPLE 7

The yarn prepared in Example 6 was annealed and restretched using the procedures described in copending application Ser. No. 758,913 (filed Sep. 11, 1991), which is a continuation of Ser. No. 358,471 (filed May 30, 1989, now abandoned), which is a continuation of Ser. No. 745,164 (filed Jun. 17, 1985, now abandoned). The properties of the annealed and restretched yarn were: 85 denier (0.72 denier/fil), 42.1 g/d tenacity, 2047 g/d/ modulus.

What is claimed is:

1. An improved process for forming fibers comprising dissolving in a solvent a spinning composition that includes a polymer selected from the group consisting of polyolefin having a molecular weight of at least 200,000 and polyvinylalcohol having a molecular weight of at least 200,000 and extruding the dissolved spinning composition through at least 1 spinneret having a substantially constant cross section and a L/D ratio greater than about twenty five to form a fiber.

2. An improved process according to claim 1 wherein the polymer is a polyolefin.

3. An improved process according to claim 1 wherein the polymer is polyvinylalcohol.

4. The improved process according to claim 2 wherein the polymer is polyethylene having a molecular weight of about 500,000 to about 4,000,000.

5. An improved process according to claim 1 wherein the L/D ratio is greater than about 60:1.

6. An improved process according to claim 2 wherein the L/D ratio is at least about 60:1.

7. An improved process according to claim 1 wherein the L/D ratio is equal to or greater than about 80:1.

8. An improved process according to claim 1 wherein the L/D ratio is equal to or greater than about 100:1.

* * * * *